US006866250B2

(12) United States Patent
Kita

(10) Patent No.: US 6,866,250 B2
(45) Date of Patent: Mar. 15, 2005

(54) TENSIONING DEVICE FOR CABLE INSERTED THROUGH FLEXIBLE TUBE

(75) Inventor: Shinichiro Kita, Yokohama (JP)

(73) Assignee: Ohi Seisakusho Co., Ltd., Yokohama (JP)

( * ) Notice: Subject to any disclaimer, the term of this patent is extended or adjusted under 35 U.S.C. 154(b) by 0 days.

(21) Appl. No.: 10/409,526

(22) Filed: Apr. 8, 2003

(65) Prior Publication Data

US 2003/0189196 A1 Oct. 9, 2003

(30) Foreign Application Priority Data

Apr. 8, 2002 (JP) ..... P2002-105357

(51) Int. Cl.[7] ..... B25B 25/00
(52) U.S. Cl. ..... 254/225; 49/280; 296/146.4
(58) Field of Search ..... 254/225; 49/360, 49/279, 280; 296/146.4, 155

(56) References Cited

U.S. PATENT DOCUMENTS 4,862,640 A * 9/1989 Boyko et al. ..... 49/213
6,026,611 A * 2/2000 Ralston et al. ..... 49/123
6,038,818 A * 3/2000 Haag et al. ..... 49/360
6,141,908 A * 11/2000 Bowen ..... 49/281
6,270,148 B1 * 8/2001 Noda et al. ..... 296/155
6,390,516 B1 * 5/2002 Kobayashi ..... 292/201
6,405,485 B1 * 6/2002 Itami et al. ..... 49/280
6,408,573 B1 * 6/2002 Fukumoto et al. ..... 49/360
6,553,719 B1 * 4/2003 Stone et al. ..... 49/358
6,557,924 B2 * 5/2003 Lauderbach et al. ..... 296/146.4
6,561,569 B1 * 5/2003 Risdon et al. ..... 296/155

* cited by examiner

*Primary Examiner*—Emmanuel Marcelo
(74) *Attorney, Agent, or Firm*—Brenda O. Holmes; Kilpatrick Stockton LLP

(57) ABSTRACT

A tensioning device for a cable inserted through a flexible tube, in which the flexible tube is fixed at one end to a stationary member, and the cable is connected to a movable member relative to the stationary member. The tensioning device includes a socket fixed to the stationary member, a plug provided on the other end of the flexible tube, a resilient member and locking means. The socket has a space therein. In the space, the plug supports the flexible tube so as to be movable in an axial direction of the cable, and the resilient member presses the plug toward the end of the space of the socket. The locking means fastens the plug in a position where the resilient member is compressed.

3 Claims, 8 Drawing Sheets

TENSIONING DEVICE FOR CABLE INSERTED THROUGH FLEXIBLE TUBE

BACKGROUND OF THE INVENTION

1. Field of the Invention

The present invention relates to a tensioning device for a cable inserted through a flexible tube, in which the cable is connected to a movable member provided on a stationary member.

2. Description of the Related Art

Some modern vehicles employ a power sliding door system in which a sliding door is automatically opened and closed by traveling along a guide rail provided on a vehicle side body.

The actuator assembly of the system includes a cable connected to the sliding door and a motor-operated drum for winding and unwinding the cable. The cable is extended from the drum through a flexible tube to the end of the guide rail, out of the flexible tube, along the guide rail, and connected to the sliding door at its end. By rotating the drum for winding or unwinding the cable thereon, the sliding door travels along the guide rail, thus allowing it to be opened or closed.

Between the end of the flexible tube and a stationary member fixed to the vehicle side body, onto which the end of the flexible tube is slidably fitted, a tensioning device is provided for imparting a given tension to the cable. The tensioning device has a coil spring for pressing the end of the flexible tube to thereby compress the flexible tube in its axial direction.

However, since the above tensioning device is not capable of temporarily removing the tension of the cable, the cable must be forcibly pulled out of the end of the flexible tube against the force of the coil spring, when connecting the end of the cable to the sliding door.

SUMMARY OF THE INVENTION

An object of the present invention is to provide a tensioning device which effectuates the simple connection of a cable to a movable member such as a sliding door.

An aspect of the present invention is a tensioning device for a cable inserted through a flexible tube, the flexible tube being fixed at one end to a stationary member, the cable being connected to a movable member relative to the stationary member, the tensioning device comprising: a socket fixed to the stationary member, having a space therein; a plug provided on the other end of the flexible tube, by which the flexible tube is supported on the stationary member so as to be movable in the space thereof in an axial direction of the cable; a resilient member for pressing the plug toward the end of the space of the socket; and locking means for fastening the plug to a position where the resilient member is compressed.

BRIEF DESCRIPTION OF THE DRAWINGS

The invention will now be described with reference to the accompanying drawings, wherein.

DETAILED DESCRIPTION OF THE PREFERRED EMBODIMENTS

An embodiment of the present invention adopted in a power sliding door system will be explained below with reference to the drawings. Note that, in FIGS. 2 and 3, "front" and "rear" of the vehicle of FIG. 1 are on right and left sides, respectively.

Figure 1:
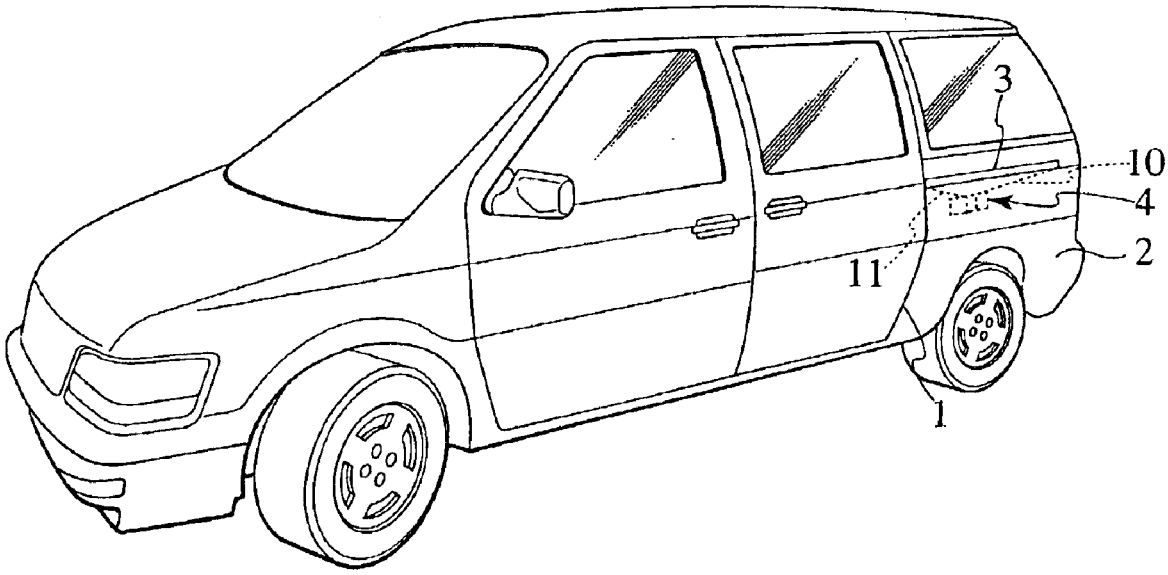
FIG. 1 is a perspective view of a vehicle adopting a tensioning device according to an embodiment of the present invention.

In the power sliding door system, a sliding door 1 as a movable member is supported, as shown in FIG. 1, on a vehicle body panel 2 so as to be slidable in a vehicle longitudinal direction.

The sliding door 1 is guided by longitudinally extending upper and lower guide rails (not shown) provided on upper and lower peripheral edges around a door opening on the body panel 2, respectively, and a longitudinally extending center guide rail 3 fixed on rear side of the body panel 2. The sliding door 1 travels along the guide rails between a closed position at the front end of the travel, where the sliding door closes the door opening, and an open position at the rear end of the travel, where the door opening is fully opened (not shown). Moreover, the guide rails guide the sliding door 1 so that the sliding door 1 moves rearward and outward in a vehicle transverse direction slantwise, when the sliding door starts to travel from the closed position to the open position, before traveling parallel to the body panel 2.

Figure 2:
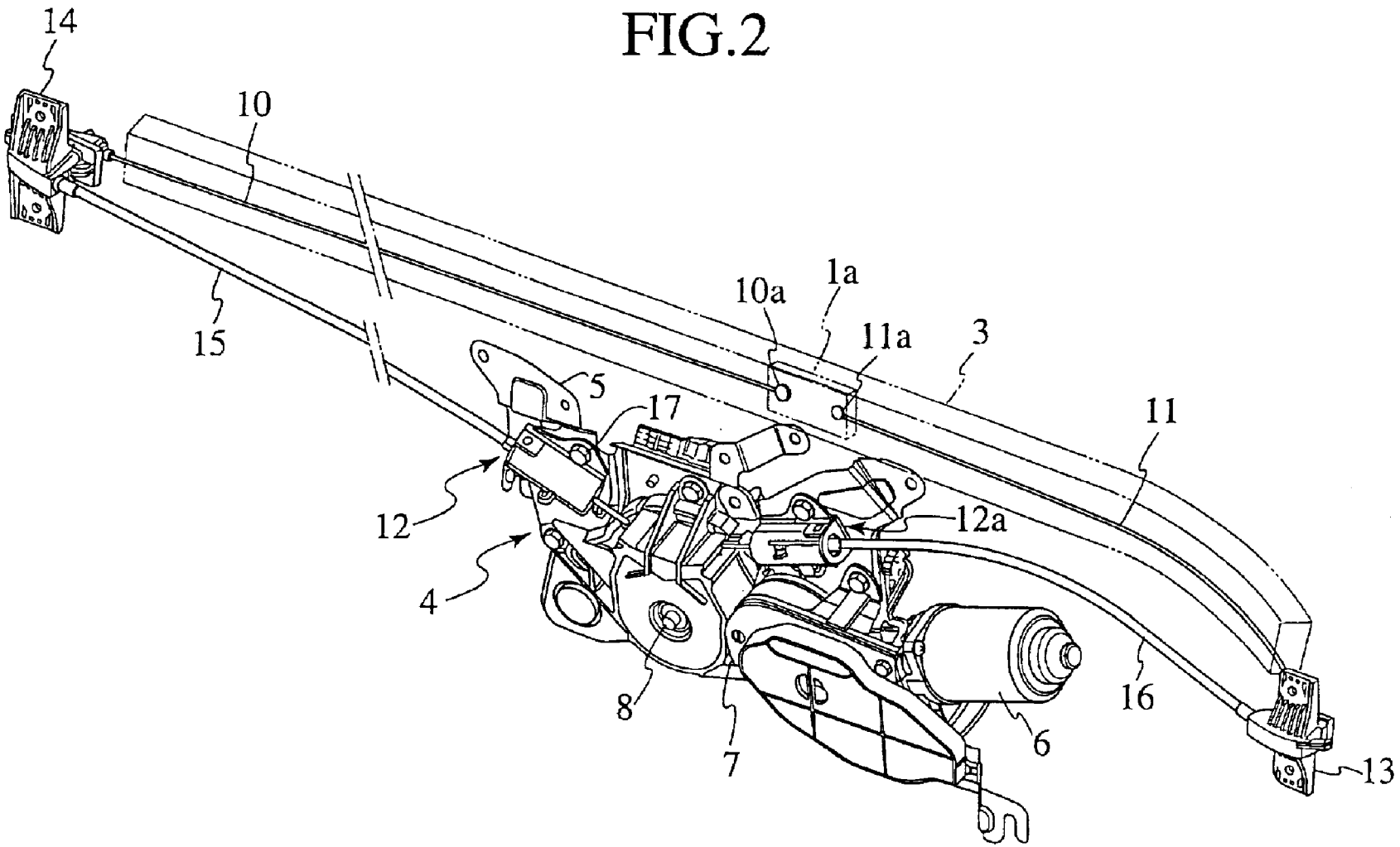
FIG. 2 is a perspective view of an actuator assembly adopting the tensioning device according to the embodiment of the present invention, which is viewed from inside the passenger compartment of the vehicle.
Figure 3:
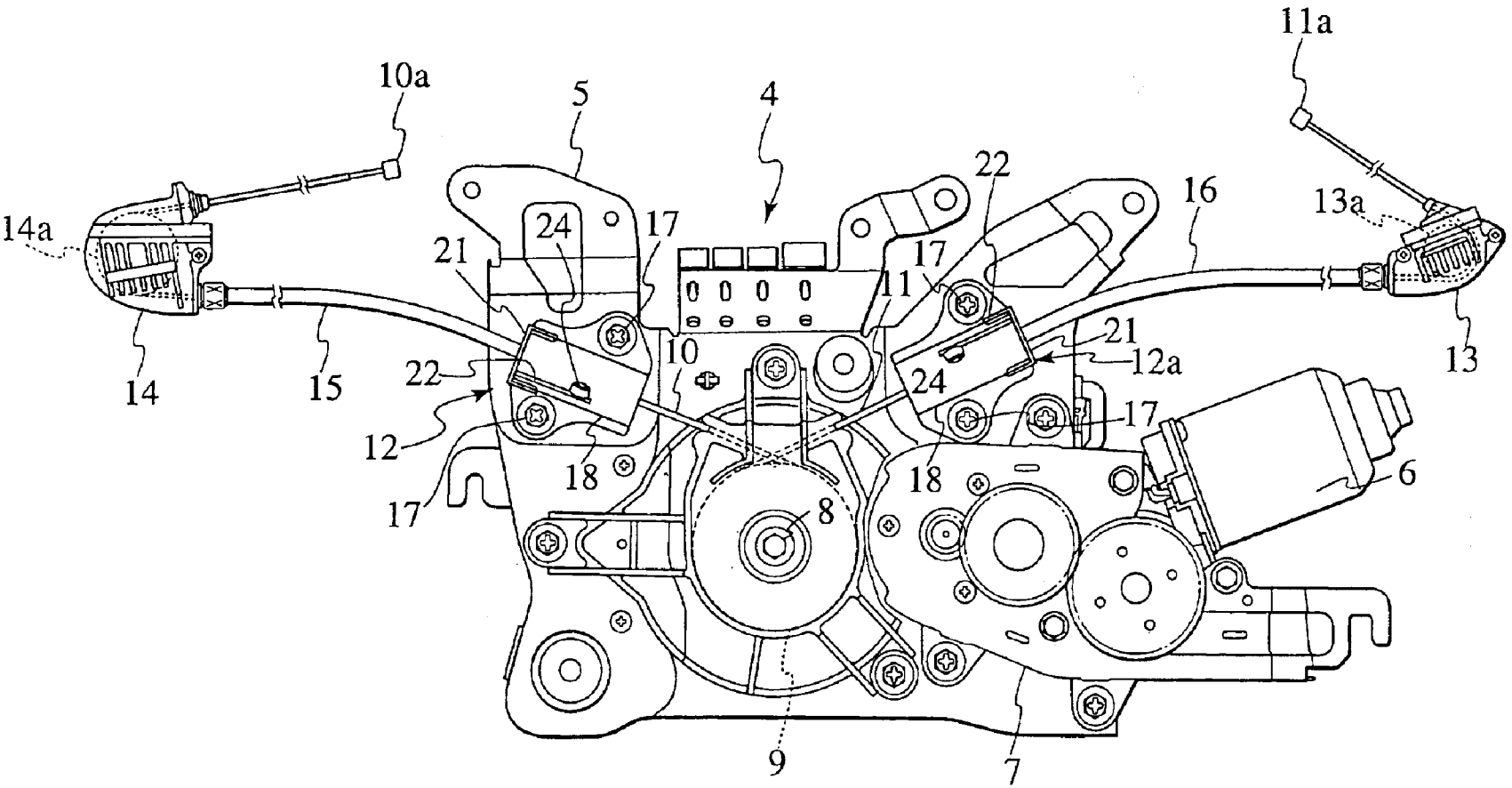
FIG. 3 is a side view of a principle portion of the actuator assembly of FIG. 2, which is viewed from inside the passenger compartment of the vehicle.
Figure 4:
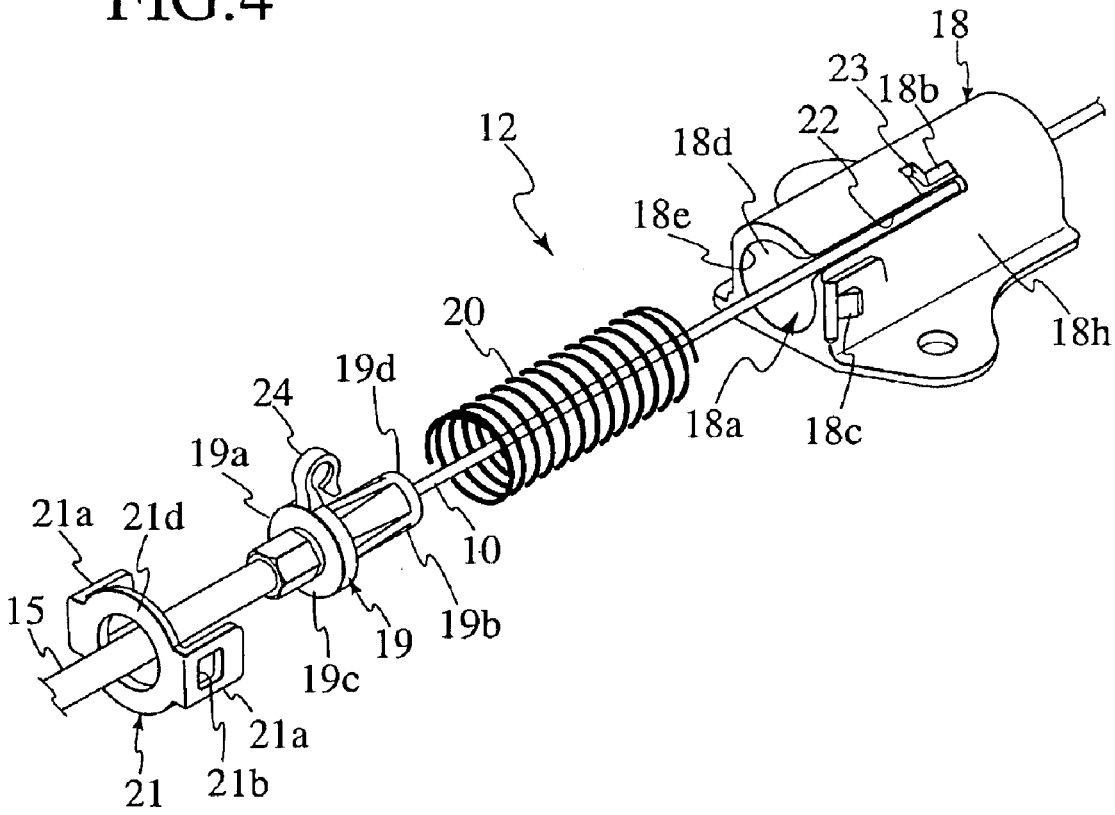
FIG. 4 is an exploded perspective view of the tensioning device according to the embodiment of the present invention.
Figure 5:
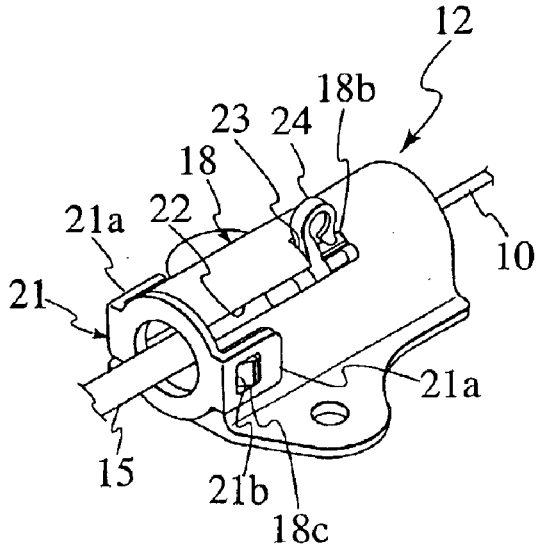
FIG. 5 is a perspective view of the tensioning device of FIG. 4, which specifically shows a plug temporarily retained in a socket.

An actuator assembly 4 of the power sliding door system, as shown in FIG. 2 and FIG. 3, is installed inside the body panel 2.

The actuator assembly 4 includes: a base plate 5 as a stationary member fixed to an inner side of the body panel 2 with bolts (not shown); a motor 6 rotatable in both forward and rearward directions; a gear box 7 for reducing the rotation speed of the motor 6, which includes gears, an electromagnetic clutch and the like; a drum 9 pivotally mounted on a shaft 8 extending in the vehicle transverse direction and engaged with the gears of the gear box 7 to rotate in both forward and rear ward directions, the drum 9 has on its outer circumference spiral grooves to put cables wound thereon into position; an opening cable 10 and a closing cable 11 wound around the drum 9 to be fed out of and rewound to the drum 9 as the drum 9 rotates; and rear and front tensioning devices 12 and 12*a* which impart tension to the opening cable 10 and the closing cable 11, respectively.

A front guide member 13 for changing the direction of the closing cable 11 is fixed to the body panel 2 in the vicinity of the front end of the center guide rail 3. The front guide member 13 has a pulley 13*a* pivotally mounted inside the front guide member 13 so as to be rotatable about a vertical axis.

A rear guide member 14 for changing the direction of the opening cable 10 is fixed to the body panel 2 in the vicinity of the rear end of the center guide rail 3. The rear guide member 14 has a pulley 14*a*pivotally mounted inside the rear guide member 14 so as to be rotatable about a vertical axis.

Between the rear tensioning device 12 and the rear guide member 14, a flexible tube 15 is extended in a slightly curved manner with the opening cable 10 slidably inserted therein.

The rear end of the flexible tube 15 is fixed to the rear guide member 14, and the front end thereof is supported by the rear tensioning device 12 so as to be slidable in an axial direction of the cable 10.

Between the front tensioning device 12*a* and the front guide member 13, a flexible tube 16 is extended in a slightly curved manner with the closing cable 11 slidably inserted therein.

The front end of the flexible tube 16 is fixed to the front guide member 13, and the rear end thereof is supported by the front tensioning device 12*a* so as to be slidable in an axial direction of the cable 11.

The opening cable 10 extending out of the rear end of the flexible tube 15 is wound around a pulley 14*a* of the rear guide member 14 so as to be oriented frontward. The cable 10 is further extended along the center guide rail 3 and connected to a guided piece 1*a* of the sliding door 1 slidably fitted to the center guide rail 3, at an end of the cable 10 via a cable end 10*a* fixed thereto.

The closing cable 11 extending out of the front end of the flexible tube 16 is wound around a pulley 13*a* of the front guide member 13 so as to be oriented rearward. The cable 11 is further extended along the center guide rail 3 and connected to a guided piece 1*a* of the sliding door 1 slidably fitted to the center guide rail 3, at an end of the cable 11 via a cable end 11*a* fixed thereto.

The drum 9 is rotated by the motor 6 through the gears inside the gear box 7.

When the drum 9 is rotated clockwise in FIG. 3, the drum 9 rewinds the opening cable 10 and simultaneously feeds out the closing cable 11 so as to move the guided piece 1*a* rearward along the center guide rail 3 to open the sliding door 1.

Conversely, when the drum 9 is rotated counterclockwise in FIG. 3, the drum 9 feeds out the opening cable 10 and simultaneously rewinds the closing cable 11 so as to move the guided piece 1*a* forward along the center guide rail 3 to close the sliding door 1.

Next, description will be made regarding the constitution of the tensioning device 12 with reference to FIGS. 4 to 11. Here, the rear tensioning device 12 will be described on behalf of both the front and rear tensioning devices 12 and 12*a*, since both tensioning devices have an identical constitution.

As shown in FIG. 2 and FIG. 3, the tensioning device 12 includes: a hollow cylindrical socket 18 fixed to the base plate 5 by transversely extending bolts 17, allowing the cable 10 to be inserted therein; a plug 19 fitted on the front end of the flexible tube 15 and housed in a columnar housing space 18*a* of the socket 18 so as to be slidable along the axial direction of the cable 10 and turnable about the axis thereof; a coil spring 20 housed in the housing space 18*a* to press the plug 19 toward the rear end (on the left side in FIG. 6 or FIG. 7) of the socket 18; and a cap 21 for blocking an entrance 18*e* of the housing space 18*a* at the rear end of the socket 18.

The socket 18 has a front wall 18*f* extending radially inward from the front end of sidewall 18*h*. The front wall 18*f* is provided in the center thereof with an outlet 18*g* for the cable 10 diverging frontward.

The coil spring 20 is interposed in a compressed state between a receiver plate 19*a* of the plug 19 to be described hereinafter and the front wall 18*f* of the socket 18 opposite thereto. The coil spring 20 thus presses the front end of the flexible tube 15 via the plug 19 toward the rear end of the socket 18.

Figure 6:
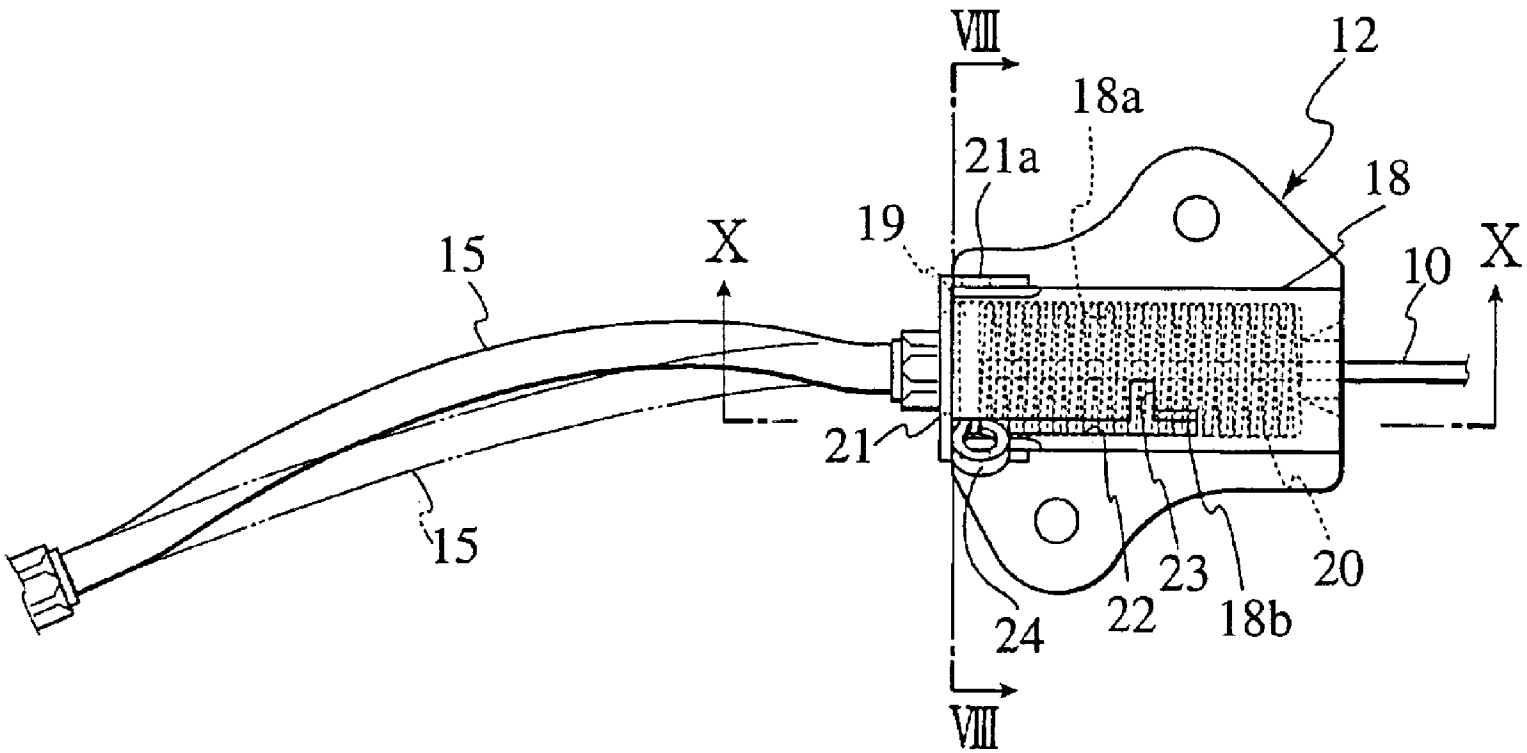
FIG. 6 is a side view of the tensioning device of FIG. 4.

When the coil spring 20 extends to displace the plug 19 toward the rear end of the socket 18, the flexible tube 15 is pushed aside in a largely curved manner as illustrated by the solid lines in FIG. 6 between the tensioning device 12 and the rear guide member 14. In other words, the flexible tube 15 is fed out of the socket 18 to lengthen the route for the cable 10 between the tensioning device 12 and the rear guide plate member 14 by the length corresponding to the displacement amount of the plug 19 in the socket 18 toward the rear end thereof, whereby the cable 10 is forced to be drawn into the flexible tube 15 on the side of its end thereof (the side where the cable 10 extends out of the rear end of the flexible tube 15 and where the cable end 10*a* is provided) by the same length, thus having tension imparted thereto.

Figure 7:
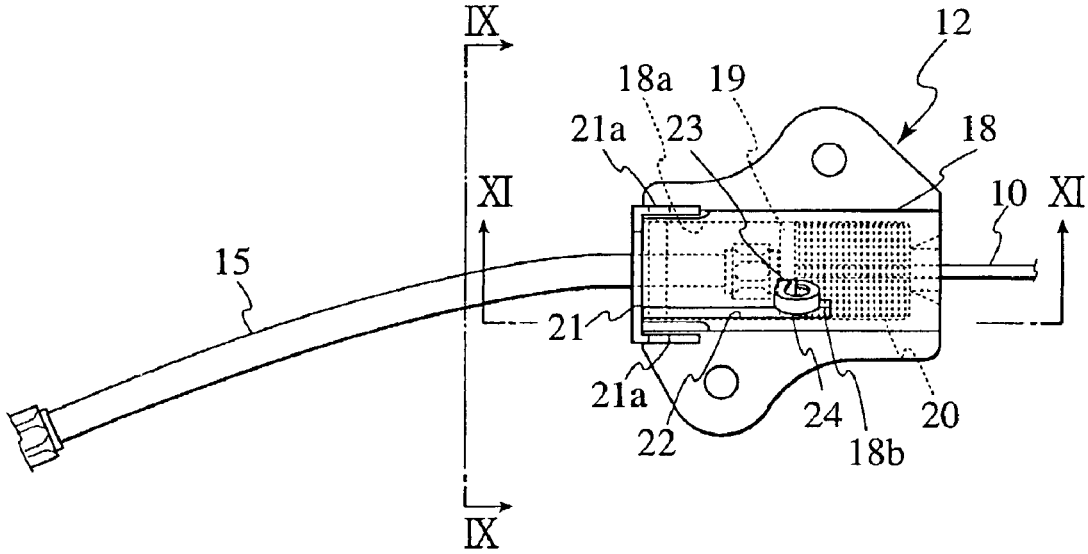
FIG. 7 is another side view of the tensioning device of FIG. 4, which specifically shows the plug temporarily retained in the socket.

Meanwhile, when the coil spring 20 is compressed and the plug 19 is thereby displaced toward the front end of the socket 18, the flexible tube 15 is stretched linearly between the tensioning device 12 and the rear guide member 14 as illustrated by the double-dashed chain lines in FIG. 6 or as shown in FIG. 7. In other words, the flexible tube 15 is drawn into the socket 18 to shorten the route for the cable 10 between the tensioning device 12 and the rear guide member 14 by the length corresponding to the displacement amount of the plug 19 in the socket 18 toward the front end thereof, whereby the cable 10 is pushed out of the flexible tube 15 on the side of its end thereof by the same length, thus having tension released therefrom.

On the side wall 18*h* of the socket 18, a longitudinal slit 22 is provided, extending in the axial direction of the cable 10 from the peripheral edge of the entrance 18*e* of the housing space 18*a* at the rear end of the socket 18 toward the front end of the socket 18. From the front end of the longitudinal slit 22, a lateral slit 23 as locking means is continuously provided to extend perpendicularly to the longitudinal slit 22 in a circumferential direction of the cable 10. A protrusion 18*b* is formed on an outer surface of the side wall 18*h* in the vicinity of the lateral slit 23.

The plug 19 has on its rear side the receiver plate 19*a* substantially in a disc shape orthogonal to the axial direction of the cable 10, the receiver plate 19*a* having a peripheral edge portion 19*c* to be slid on the inner circumferential surface 18*d* of the housing space 18*a* of the socket 18; and a conical guide spacer 19*b* extending frontward from the receiver plate 19*a* onto which the coil spring 20 is set.

When the coil spring 20 is-compressed and the plug 19 is thereby displaced to the front end of the socket 18, a front end 19*d* of the guide spacer 19*b* is brought into contact with the inner side of the front wall 18*f* of the socket 18. The guide spacer 19*b* thus defines a front-limit position of the plug 19 inside the housing space 18*a*, and also prevents the coil spring 20 from excessive compression.

The receiver plate 19*a* of the plug 19 is provided, on the peripheral edge portion 19*c* thereof, with an elastically deformable engaging portion 24, which extends radially outward therefrom and which is formed in a curved shape like a fish hook. The engaging portion 24 is formed so as to be able to travel through the longitudinal slit 22 and the lateral slit 23. When the plug 19 is displaced inside the housing space 18*a* in the axial direction of the cable 10, the engaging portion 24 slides inside the longitudinal slit 22. After the plug 19 is pushed into the front-limit position where the front end 19*d* of the guide spacer 19*b* thereof is brought into contact with the inner side of the front wall 18*f*, as the plug 19 is turned about the axis of the cable 10, the engaging portion 24 slides inside the lateral slit 23 and is elastically deformed to allow the tip 24*a* thereof to pass over the protrusion 18*b* of the socket 18, whereby the engaging portion 24 is detachably engaged with the protrusion 18*b*.

Figure 8:
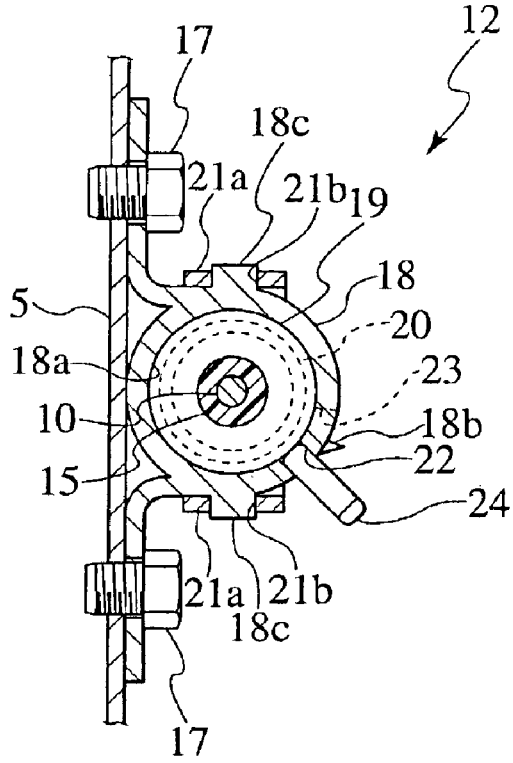
FIG. 8 is a cross sectional view taken along the VIII—VIII line in FIG. 6.
Figure 9:
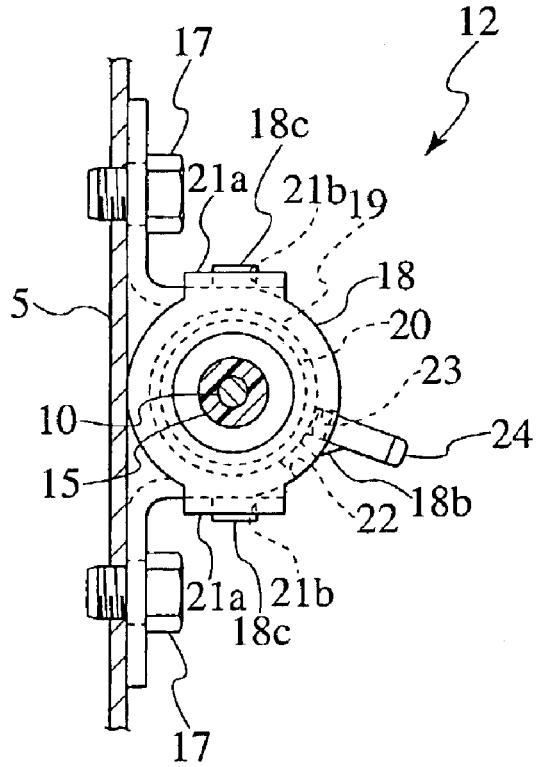
FIG. 9 is a cross sectional view taken along the IX—IX line in FIG. 7.
Figure 10:
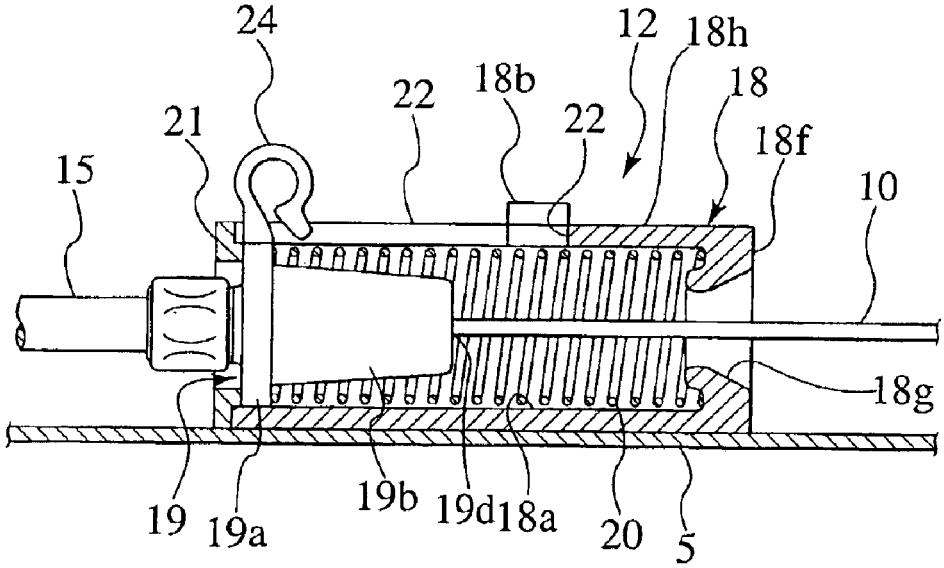
FIG. 10 is a longitudinal sectional view taken along the X—X line in FIG. 6.
Figure 11:
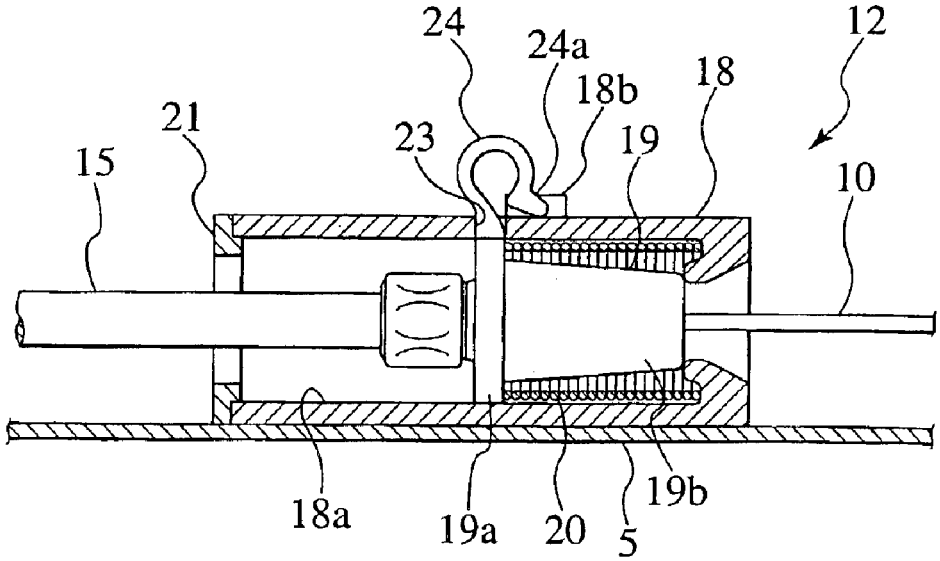
FIG. 11 is a longitudinal sectional view taken along the XI—XI line in FIG. 7.

That is to say, as shown in FIG. 6, FIG. 8 and FIG. 10, the plug 19 is displaceable in the axial direction of the cable 10 while the engaging portion 24 is fitted through the longitudinal slit 22. In the front-limit position, as shown in FIG. 7, FIG. 9 and FIG. 11, the plug 19 is turnable about the axis of the cable 10 with the engaging portion 24 fitted through the lateral slit 23 when an external force is applied to the engaging portion 24. However, after the tip 24*a* of the engaging portion 24 passes over the protrusion 18*b* and the engaging portion 24 is thereby engaged with the protrusion 18*b*, the engagement prevents free turning of the plug 19 in the direction in which the plug 19 escapes from the lateral slit 23 into the longitudinal slit 22 (the clockwise direction in FIG. 9). When the plug 19 is set in the front-limit position, the coil spring 20 is in the most compressed state between the receiver plate 19*a* of the plug 19 and the front wall 18*f* of the socket 18. As long as the engaging portion 24 is fitted through the lateral slit 23, the plug 19 can be temporarily retained in the front-limit position, even though the compressed spring 20 pushes the plug 19 toward the rear end of the socket 18.

The cap 21 is attached to the rear end of the socket 18 for closing the entrance 18*e* of the housing space 18*a* to keep the coil spring 20 and the plug 19 in the housing space 18*a*. The cap 21 has a ring portion 21*d* to be in contact with the rear side of the receiver plate 19*a* of the plug 19, allowing penetration of the flexible tube 15 in the center thereof; and a pair of elastically deformable locking pieces 21*a* extending frontward from mutually opposite sides on the outer periphery of the ring portion 21*d*. The locking pieces 21*a* are respectively provided with openings 21*b* which the projections 18*c*, provided on the outer surface of the side wall 18*h*, are fitted into. As the cap 21 is pushed onto the rear end of the socket 18, the locking pieces 21*a* elastically deform to allow the projections 18*c* to fit into the openings 21*b* for engagement, and the cap 21 is thus fastened to the socket 18, whereby the coil spring 20 and the plug 19 are locked in the housing space 18*a*.

Next, description will be made regarding procedures for connecting the opening cable 10 to the sliding door 1.

In this embodiment, the plug 19 of the tensioning device 12 is temporarily retained in the front-limit position with the coil spring 20 compressed, before connecting the cable end 10*a* of the cable 10 to the guided piece 1*a* of the sliding door 1.

To retain the plug 19 temporarily in the front-limit position, the plug 19 is first displaced frontward to the front-limit position against the force of the coil spring 20, then turned counterclockwise in FIG. 8 about the axis of the cable 10 by applying external force onto the engaging portion 24, whereby the engaging portion 24 is set in the lateral slit 23 in engagement with the protrusion 18*b* of the socket 18.

As the plug 19 is retained in the front-limit position, the cable 10 is pushed out of the end of the flexible tube 15 by the length corresponding to the displacement amount of the plug 19 in the socket 18 toward the front end thereof. This eliminates the procedure of pulling the cable 10 out of the flexible tube 15 against the force of the coil spring 20, when connecting the cable end 10*a* to the guided piece 1*a*, whereby the cable 10 can be readily connected to the guided piece 1*a*.

During the above connecting work, the engaging portion 24 is prevented from escaping from the lateral slit 23 by engagement with the protrusion 18*b* of the socket 18. The plug 19 is thus securely retained in the front-limit position, and the tension of the cable 10 is removed and the cable 10 is maintained in a relaxed state, thus improving the workability of the connecting work.

After connecting the cable end 10*a* to the guided piece 1*a*, the plug 19 is turned clockwise in FIG. 9. Traveling in the lateral slit 23 to the longitudinal slit 22, the engaging portion 24 elastically deforms to allow the tip 24*a* thereof to pass over the protrusion 18*b*. The plug 19 is then displaced toward the rear end of the socket 18 by extension of the coil spring 20, and the flexible tube 15 is pushed out of the socket 18 by the length corresponding to the displacement amount, whereby tension is imparted to the cable 10.

Similarly, regarding the closing cable 11, the cable end 11*a* is connected to the guided piece 1*a* by the same procedures.

In other words, the tensioning device 12 for the cable 10 inserted through the flexible tube 15, in which one end of the flexible tube 15 is fixed to the stationary member 5 and the other end thereof is supported on the stationary member 5 so as to be movable in an axial direction of the cable 10, and the cable 10 is connected to the movable member 1 movably supported by the stationary member 5, imparts tension to the cable 10 extending out of the other end of the flexible tube 15 in such a manner that the coil spring 20 presses the movable end of the flexible tube 15.

In this embodiment, the socket 18 is fixed to the stationary member 5 and is formed to have a space 18*a* therein, through which the cable 10 is inserted. The plug 19 is attached to the other end of the flexible tube 15 and supports the flexible tube so as to be movable in the space 18*a* in the axial direction of the cable 10. Moreover, the coil spring 20 is interposed in a compressed state between the plug 19 and the front wall 18*f* of the socket 18. Furthermore, the socket 18 is provided with locking means for fastening the plug 19 to an assembly position where the coil spring 20 is compressed.

According to the above structure, the cable 10 can be retained temporarily in the state of being pushed out of the other end of the flexible tube 15. Therefore, the end of the cable 10 can be readily connected to the movable member 1 without pulling the cable 10 out of the other end of the flexible tube 15 against the force of the coil spring 20.

Moreover, in this embodiment, the space 18*a* of the socket 18 is formed in a columnar shape and the socket 18 is formed to have, on the side wall 18*h* of the space 18*a*, the longitudinal slit 22 extending in a longitudinal direction of the space 18*a* and the lateral slit 23 extending in a circumferential direction of the space 18*a*, and the plug 19 is provided with the engaging portion 24 to be slid in the longitudinal slit 22 as the plug 19 slides in the space 18*a* in the longitudinal direction thereof, and to be slid in the lateral slit 23 as the plug 19 turns in the space 18*a* about the axis of the cable 10. Moreover, the lateral slit 23 of the socket 18 and the engaging portion 24 of the plug 19 constitute the locking means.

According to the above structure, the plug 19 can be temporarily secured in the assembly position with the coil spring 20 maintained in a compressed position. In addition, the plug 19 can be easily released from the assembly position for imparting tension to the cable 10.

Furthermore, the socket 18 is formed to have the protrusion 18*b* on its side wall 18*h* in the vicinity of the lateral slit 23, and the engaging portion 24 of the plug 19 is formed to be elastically deformable to engage with and disengage from the protrusion 18*b*.

According to the above structure, the engaging portion 24 is prevented from escaping from the lateral slit 23 during the connecting work of the cable 10, thus improving the efficiency of the connecting work.

Although the preferred embodiment described herein is applied to an actuator assembly for opening and closing the sliding door 1, the invention may be practiced or embodied in other ways without departing from the spirit or essential character thereof. The present invention is also applicable to other actuator assemblies such as a window regulator which opens and closes windows. The scope of the invention being indicated by the claims, and all variations which come within the meaning of the claims are intended to be embraced herein.

The present disclosure relates to subject matter contained in Japanese Patent Application No. 2002-105357, filed on Apr. 8, 2002, the disclosure of which is expressly incorporated herein by reference in its entirety.

What is claimed is:

1. A tensioning device for a cable inserted through a flexible tube, the flexible tube being fixed at one end to a stationary member, the cable being connected to a movable member relative to the stationary member, the tensioning device comprising:

a socket fixed to the stationary member, having a housing space therein;

a plug provided on the other end of the flexible tube, the plug being movable in the space of the housing socket in an axial direction of the cable; and a resilient member for pressing the plug toward an end of the housing space;

wherein the plug is engageable with the socket for being fastened in a position where the resilient member is compressed.

2. A tensioning device for a cable inserted through a flexible tube, the flexible tube being fixed at one end to a stationary member, the cable being connected to a movable member relative to the stationary member, the tensioning device comprising:

a socket fixed to the stationary member, having a space therein;

a plug provided on the other end of the flexible tube, by which the flexible tube is supported on the stationary member so as to be movable in the space of the socket in an axial direction of the cable;

a resilient member for pressing the plus toward an end of the space; and locking means for fastening the plug to a position where the resilient member is compressed, wherein the space of the socket is formed in a columnar shape and the socket is formed to have, on a side wall of the space, a first slit extending in a longitudinal direction of the space and a second slit extending in a circumferential direction of the space, and the plug is provided with an engaging portion to be slid in the first slit as the plug slides in the space, and to be slid in the second slit as the plug turns in the space, and wherein the second slit of the socket and the engaging portion of the plug constitute the locking means.

3. The tensioning device according to claim 2, wherein the socket is formed to have a protrusion on its side wall in the vicinity of the second slit, and the engaging portion of the plug is formed to be engageable with the protrusion.

* * * * *